US011082795B2

(12) United States Patent
Cheon et al.

(10) Patent No.: US 11,082,795 B2
(45) Date of Patent: Aug. 3, 2021

(54) ELECTRONIC APPARATUS AND CONTROL METHOD THEREOF

(71) Applicant: SAMSUNG ELECTRONICS CO., LTD., Suwon-si (KR)

(72) Inventors: Byeonggeun Cheon, Suwon-si (KR); Jaeyoun Cho, Suwon-si (KR); Shukjae Choi, Suwon-si (KR); Byeongseob Ko, Suwon-si (KR); Sangmo Son, Suwon-si (KR); Hyeonsik Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/710,150

(22) Filed: Dec. 11, 2019

(65) Prior Publication Data

US 2020/0196088 A1 Jun. 18, 2020

(30) Foreign Application Priority Data

Dec. 17, 2018 (KR) ..... 10-2018-0163183

(51) Int. Cl.
*H04S 7/00* (2006.01)
*H04R 29/00* (2006.01)

(52) U.S. Cl.
CPC ..... *H04S 7/305* (2013.01); *H04R 29/001* (2013.01); *H04S 7/307* (2013.01)

(58) Field of Classification Search
CPC ..... H04S 7/301; H04S 7/302; H04S 7/307; H04R 5/04; H04R 1/22; H04R 3/04; H03G 3/20; H03G 5/16; H03G 5/165
See application file for complete search history.

(56) References Cited

U.S. PATENT DOCUMENTS 6,195,435 B1 * 2/2001 Kitamura ..... H04S 7/301 381/104
2002/0136414 A1 * 9/2002 Jordan ..... H04S 3/00 381/58

(Continued)

FOREIGN PATENT DOCUMENTS

KR 10-0740297 7/2007
WO 2014/076030 5/2014

OTHER PUBLICATIONS

F. Alton Everest, et al., Master Handbook of Acoustics, 2015, Chapter 13, Sixth Edition, McGraw-Hill. (Year: 2015).*

(Continued)

*Primary Examiner* — Kile O Blair
(74) *Attorney, Agent, or Firm* — Nixon & Vanderhye P.C.

(57) ABSTRACT

Disclosed is an electronic apparatus. The electronic apparatus outputs a first sound having a first characteristic for measuring a listening environment through an output unit, acquires first listening environment information based on a first feedback sound received through a receiving unit based on the output first sound, outputs a second sound having a second characteristic through the output unit based on receiving input through the receiving unit, acquires second listening environment information based on a second feedback sound received through the receiving unit based on the output second sound, and performs audio correction based on the acquired first listening environment information and second listening environment information.

19 Claims, 10 Drawing Sheets

(56) References Cited

U.S. PATENT DOCUMENTS

| | | | | |
|---|---|---|---|---|
| 2008/0175394 | A1* | 7/2008 | Goodwin | H04S 3/008 381/1 |
| 2009/0220100 | A1 | 9/2009 | Ohta et al. | |
| 2017/0013345 | A1* | 1/2017 | Kumar | G10K 11/17823 |
| 2017/0215017 | A1 | 7/2017 | Hartung et al. | |
| 2017/0257722 | A1 | 9/2017 | Kerdranvat et al. | |
| 2017/0339489 | A1 | 11/2017 | Sheen | |
| 2017/0374465 | A1 | 12/2017 | Family et al. | |

OTHER PUBLICATIONS

Search Report and Written Opinion dated Apr. 8, 2020 in counterpart International Patent Application No. PCT/KR2019/017380.

* cited by examiner

ELECTRONIC APPARATUS AND CONTROL METHOD THEREOF

CROSS-REFERENCE TO RELATED APPLICATION

This application is based on and claims priority under 35 U.S.C. § 119 to Korean Patent Application No. 10-2018-0163183, filed on Dec. 17, 2018, in the Korean Intellectual Property Office, the disclosure of which is incorporated by reference herein in its entirety.

BACKGROUND

Field

The disclosure relates to an electronic apparatus and a control method thereof, and for example, to an electronic apparatus for performing audio correction according to a change in listening environment and a control method thereof.

Description of Related Art

With the rapid development of loudspeaker performance, loudspeakers have lately been able to output sound of improved quality like live sound. For example, although a user does not participate in a concert in person, a loudspeaker outputs concert sound to make the user feel realism and sound field effects as if he or she participated in the concert.

Because sound quality may vary depending on the listening environment of a user, the user may enjoy sound of better quality through sound correction based on a current listening environment. For example, when the listening environment is changed, the user may cause a loudspeaker to measure the current listening environment and output sound of appropriate quality for the current listening environment.

SUMMARY

Embodiments of the disclosure provide an electronic apparatus, which can improve reliability in measuring a listening environment by actively measuring a listening environment according to whether it is an appropriate situation to measure a listening environment and can lessen acoustic stress of a user by unconsciously measuring the listening environment, and a method of controlling the electronic apparatus.

According to an example aspect of the disclosure, an electronic apparatus is provided, the electronic apparatus comprising: an output unit comprising output circuitry; a receiving unit comprising receiving circuitry; and a processor configured to control the electronic apparatus to: output a first sound having a first characteristic for measuring a listening environment through the output unit, acquire first listening environment information based on a first feedback sound received through the receiving unit based on the output first sound, output a second sound having a second characteristic through the output unit based on an input received through the receiving unit, acquire second listening environment information based on a second feedback sound received through the receiving unit based on the output second sound, and perform audio correction based on the acquired first listening environment information and second listening environment information.

The first listening environment information may include information about resonance of the first sound caused by an ambient space of the electronic apparatus.

The first characteristic may include a characteristic of an inaudible frequency band for measuring the resonance of the output first sound.

The second listening environment information may include information about reverberation of the second sound caused by an ambient space.

The second characteristic may include a characteristic of an audible frequency band for measuring the reverberation of the output second sound.

The input may include an input for performing a predetermined function of the electronic apparatus.

The predetermined function may include at least one of power control, channel switching, or volume control of the electronic apparatus.

The second characteristic may include a characteristic of a predetermined frequency band based on the function to be performed.

The processor may control the electronic apparatus to: decompose content audio into primary components and ambient components based on the acquired first listening environment information and second listening environment information and perform audio correction.

The processor may control the electronic apparatus to: divide a frequency band of content audio based on the acquired first listening environment information and second listening environment information and perform audio correction.

The electronic apparatus further comprises: a remote control configured to receive the first feedback sound and the second feedback sound; and a communication unit comprising communication circuitry configured to wirelessly communicate with the remote control.

The processor may control the electronic apparatus to: sequentially receive a signal of the first feedback sound and a signal of the second feedback sound from the remote control through the communication unit.

The processor may control the electronic apparatus to: change at least one of the first characteristic or the second characteristic based on a change in listening environment detected based on the acquired first listening environment information and second listening environment information.

The processor may control the electronic apparatus to: increase output frequencies of the first sound and the second sound based on a change in listening environment detected based on the acquired first listening environment information and second listening environment information.

According to another example aspect of the disclosure, a method of controlling an electronic apparatus is provided, the method comprising: outputting a first sound having a first characteristic for measuring a listening environment; acquiring first listening environment information based on a first feedback sound received based on the output first sound; outputting a second sound having a second characteristic based on an input; acquiring second listening environment information based on a second feedback sound received based on the output second sound; and performing audio correction based on the acquired first listening environment information and second listening environment information.

The first listening environment information may include information about resonance of the first sound caused by an ambient space of the electronic apparatus.

The first characteristic may include a characteristic of an inaudible frequency band for measuring the resonance of the output first sound.

The second listening environment information may include information about reverberation of the second sound caused by an ambient space.

The second characteristic may include a characteristic of an audible frequency band for measuring the reverberation of the output second sound.

The input may include an input for performing a predetermined function of the electronic apparatus.

According to another example aspect of the disclosure, a recording medium in which a computer program comprising a computer-readable code for performing a method of controlling an electronic apparatus is stored is provided, the method of controlling an electronic apparatus comprising: outputting a first sound having a first characteristic for measuring a listening environment; acquiring first listening environment information based on a first feedback sound received based on the output first sound; outputting a second sound having a second characteristic based on an input; acquiring second listening environment information based on a second feedback sound received based on the output second sound; and performing audio correction based on the acquired first listening environment information and second listening environment information.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
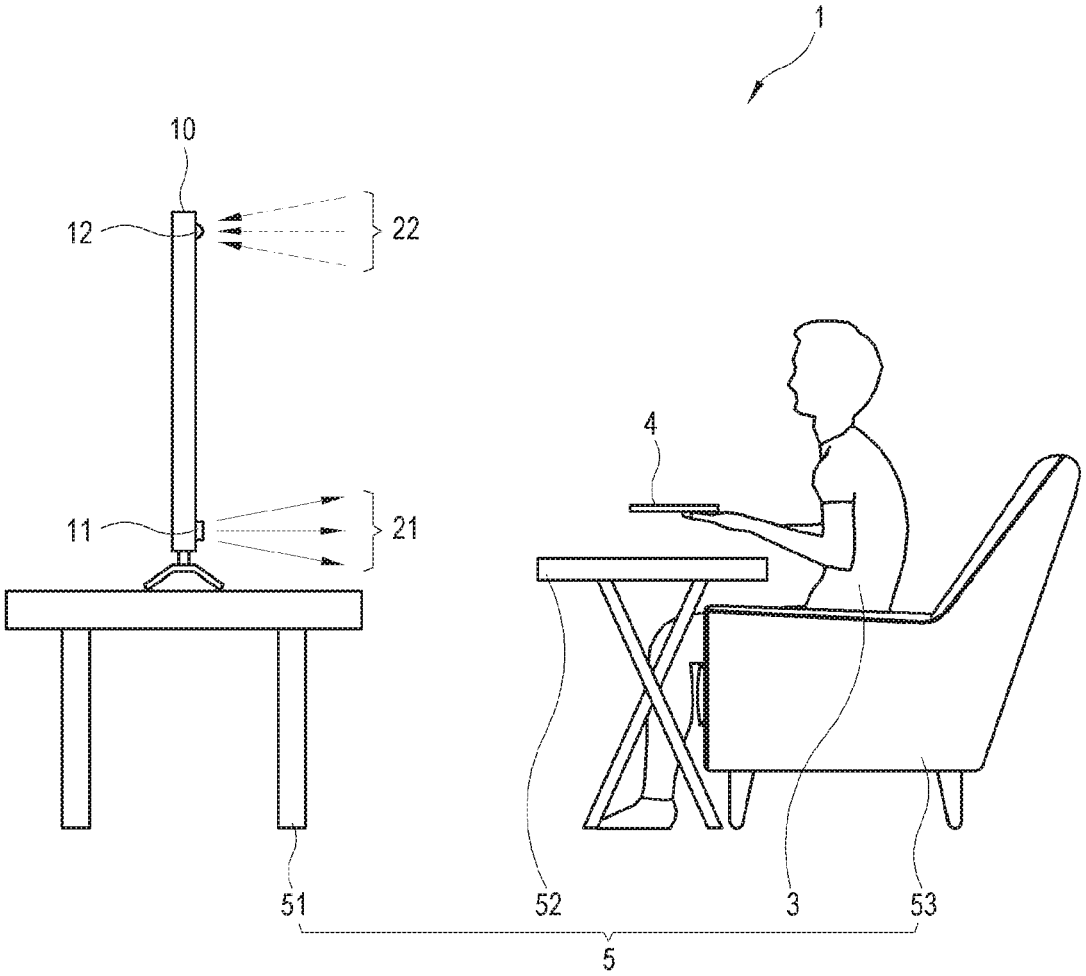
FIG. 1 is a diagram illustrating an example electronic apparatus according to an embodiment of the disclosure.

Hereinafter, various example embodiments of the disclosure will be described in greater detail with reference to the accompanying drawings. Throughout the drawings, like reference numerals or signs represent components performing substantially the same function. In embodiments of the disclosure, at least one of a plurality of elements indicates all the elements, each of the elements, or all combinations of the elements.

FIG. 1 is a diagram illustrating an example electronic apparatus 10 according to an embodiment of the disclosure. As shown in FIG. 1, the electronic apparatus 10 according to an example embodiment may be provided in a predetermined space 1. The space 1 may include, for example, and without limitation, a living room, a room, a kitchen, or the like, of a general house in which a user 3 may reside, an office, a public place, etc. but is not limited thereto.

The space 1 may include occupying objects around the electronic apparatus 10. The occupying objects may occupy or form the space 1. In the case of a living room by way of example, the occupying objects may include not only structures forming the living room, such as doors, windows, pillars, and the internal shape of the living room, but also furniture 5, such as a shelf 51 supporting the electronic apparatus 10, a table 52, and a chair 53, electronic appliances, such as an air conditioner (not shown) and a refrigerator (not shown), a user 3, and the like. For convenience of description, it is assumed below that the space 1 in which the electronic apparatus 10 exists is a living room and there are the user 3 and the furniture 5 in the living room, in addition to the electronic apparatus 10.

The electronic apparatus 10 may output sound of the audio of content (hereinafter "content audio"). The content may be received from the outside of the electronic apparatus or stored in the electronic apparatus 10 and may be broadcast content, cable content, radio content, etc. For example, when the electronic apparatus 10 is implemented as a television (TV), the TV may receive a signal of content including audio from a broadcasting station and output sound of the received content audio. However, implementation examples of the electronic apparatus 10 are not limited to that shown in FIG. 1. Therefore, the electronic apparatus 10 may also be implemented not only as a remote control 4, a smart phone, a tablet, a personal computer, a wearable device, such as a smart watch, and home appliances, such as a multimedia player, an electronic frame, and a refrigerator, which can output sound but also as artificial intelligence (AI) speaker which can communicate with a user through an AI algorithm. For convenience of description, the electronic apparatus 10 is assumed to be a TV below.

The electronic apparatus 10 may output sound of content audio through a speaker 11. The speaker 11 may be provided in the electronic apparatus 10 or may be an external speaker provided outside the electronic apparatus 10. The external speaker may receive a sound signal from the electronic apparatus 10 through wired or wireless communication and output sound based on the sound signal together with or independently of the internal speaker 11. The external speaker may include not only a sole speaker but also various external sound systems having a speaker. However, for convenience of description, it is assumed below that sound 21 is output through the internal speaker 11.

The electronic apparatus 10 may further include a receiver (e.g., including receiving circuitry) 12. The receiver 12 may receive sound or a user input. When the receiver receives sounds, the electronic apparatus 10 may identify feedback sound 22 corresponding to the sound 21 of the speaker 11 among the received sounds. For example, the electronic apparatus 10 may identify the sound 22 corresponding to the sound 21 among various sounds received through the receiver 12 in consideration of characteristics of the sound 21, such as volume, phase, and frequency.

The receiver 12 may be provided to receive a user input. The receiver 12 may receive various user inputs according to a user input method. For example, the receiver 12 may include a remote control signal module including various circuitry which receives a remote control signal from the remote control 4.

The electronic apparatus 10 may output the sound 21 to measure a listening environment of the space 1. Because the listening environment may be measured in consideration of an actual feeling of the user 3 about an output sound, the electronic apparatus 10 may measure the listening environment based on the sound 21 in an audible frequency band that the user 3 can hear. In other words, the electronic apparatus 10 may output the sound 21 in the audible frequency band, receives the feedback sound 22 through the receiver 12 according to the sound 21, and measure the listening environment based on a characteristic difference between the sound 21 and the feedback sound 22. The characteristic difference may include a difference in volume, phase, etc. between the sound 21 and the feedback sound 22.

The electronic apparatus 10 may measure the listening environment by outputting the sound 21 in an inaudible frequency band instead of the audible frequency band or the sound 21 in the audible frequency band and the inaudible frequency band. As an example, to remove aversion of the user 3 to the sound 21 in the audible frequency band, the electronic apparatus 10 may output the sound 21 in the inaudible frequency band instead of the audible frequency band and measure the listening environment based on the feedback sound 22 corresponding to the sound 21. As another example, when the sound 21 in the inaudible frequency band may improve reliability in measuring the listening environment compared with the sound 21 in the audible frequency band, the electronic apparatus 10 may output the sound 21 in the inaudible frequency band instead of the audible frequency band or output the sound 21 in the audible frequency band and the inaudible frequency band.

For example, the electronic apparatus 10 according to an example embodiment may output the sound 21 for measuring the listening environment according to a state of the user 3. The state of the user 3 may include a listening state in which the user 3 listens to the sound 21 or can hear the sound 21 and a non-listening state in which the user 3 does not listen to the sound 21 or cannot hear the sound 21. For example, when there is a user input for performing a predetermined function, the electronic apparatus 10 may identify the state of the user 3 as the listening state and output the sound 21 in at least one of the audible frequency band and the inaudible frequency band according to the listening state.

The electronic apparatus 10 may output appropriate sound of content audio for the listening environment by correcting the content audio based on the listening environment measured in the listening state. For example, the electronic apparatus 10 may measure reverberation in the space 1 based on a characteristic difference between the sound 21 and the feedback sound 22 in an audible frequency band or may measure resonance in the space 1 based on a characteristic difference between the sound 21 and the feedback sound 22 in the inaudible frequency band. The electronic apparatus 10 may correct content audio based on the measured reverberation or resonance and output sound of the content audio which has been compensated for the reverberation or resonance.

The electronic apparatus 10 according to an example embodiment may measure a listening environment by outputting the sound 21 for measuring a listening environment according to a state of the user 3 and correct content audio according to the measured listening environment. The electronic apparatus 10 according to an example embodiment may improve reliability in measuring a listening environment by actively measuring a listening environment according to whether it is an appropriate situation to measure a listening environment and may output appropriate sound of content audio for the listening environment.

Figure 2:
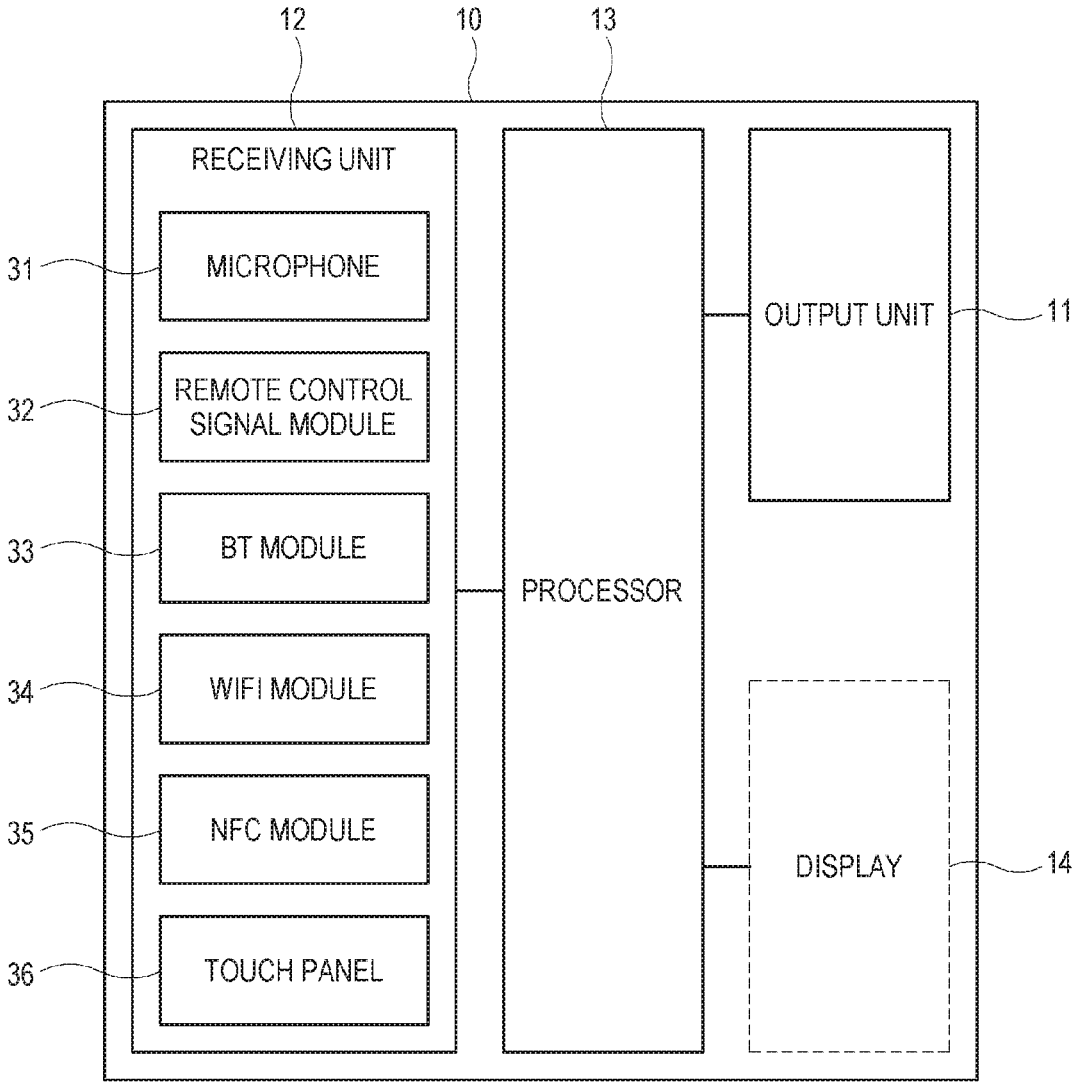
FIG. 2 is a block diagram illustrating an example configuration of the electronic apparatus of FIG. 1 according to an embodiment of the disclosure.

FIG. 2 is a block diagram illustrating an example configuration of the electronic apparatus 10 of FIG. 1 according to an embodiment of the disclosure. As shown in FIG. 2, the electronic apparatus 10 according to an example embodiment may include an output unit (e.g., including output circuitry) 11, a receiving unit (e.g., including receiving circuitry) 12, and a processor (e.g., including processing circuitry) 13.

The output unit 11 may include various output circuitry, such as, for example, and without limitation, at least one speaker 11 and may output sound of content audio or sound for measuring a listening environment. The speaker 11 may be provided in the electronic apparatus 10 or implemented as an external speaker. When the speaker 11 is implemented as an external speaker, the output unit 11 may be connected to the external speaker and output a sound signal to the external speaker. In this case, the output unit 11 may output the sound signal by wire or wirelessly according to a connection method. For example, the output unit 11 may output the sound signal to the external speaker through at least one of wired communication, such as high definition multimedia interface (HDMI), universal serial bus (USB), and wired local area network (LAN), and wireless communication, such as wireless high definition (WiHD), Bluetooth (BT), Bluetooth low energy (BLE), infrared data association (IrDA), wireless fidelity (Wi-Fi), ZigBee, Wi-Fi direct (WFD), ultra-wideband (UWB), and near field communication (NFC), etc. The output unit 11 may be implemented as two or more communication modules or one integrated module for performing wired or wireless communication.

The receiving unit 12 may include various receiving circuitry and receive the feedback sound 22 corresponding to the sound 21. The receiving unit 12 may remove various noises included in the feedback sound 22 through a preprocessing process such as frequency analysis of the feedback sound 22. The receiving unit 12 may include, for example, and without limitation, at least one microphone 31 for receiving the feedback sound 22.

Also, when an external device receives the feedback sound 22, the receiving unit 12 may receive a signal of the feedback sound 22 from the external device. To this end, the receiving unit 12 may include various modules, each including circuitry that may be defined by the function of the module, such as, for example, and without limitation, a remote control signal module 32, a BT module 33 capable of BT communication or BLE communication, a Wi-Fi module 34 capable of Wi-Fi communication, an NFC module 35 capable of NFC, and the like. For example, when the remote control 4 may receive the feedback sound 22 corresponding to the sound 21, the receiving unit 12 may receive a signal of the feedback sound 22 from the remote control 4 through the remote control signal module 32.

Further, the receiving unit 12 may include various circuitry to receive various inputs according to user input methods. For example, the receiving unit 12 may include, without limitation, a menu button provided on an external side of the electronic apparatus 10 or a touch panel 36 provided in a display 14 to receive, for example, a touch input of a user.

The processor 13 may include various processing circuitry and control operation of all the elements of the electronic apparatus 10. In other words, when it is described herein that a processor performs a particular function, it is to be understood that the processor may control the electronic apparatus 10 to perform the function, and is not limited to the processor itself performing the function. For example, the processor 13 may output a first sound having a first characteristic for measuring a listening environment through the output unit 11 and acquire first listening environment information based on a first feedback sound received through the receiving unit 12 according to the output first sound. As an example, the processor 13 may output a first sound 21 in the inaudible frequency band for measuring a listening environment and acquire first listening environment information based on a first feedback sound 22 corresponding to the first sound 21.

The processor 13 may output a second sound having a second characteristic through the output unit 11 according to a user input received through the receiving unit 12 and may acquire second listening environment information based on second feedback sound received through the receiving unit 12 according to the output second sound. As an example, the processor 13 may output a second sound 21 in an audible frequency band for measuring a listening environment and acquire second listening environment information based on a second feedback sound 22 corresponding to the second sound 21.

The processor 13 may correct content audio based on the first listening environment information and the second listening environment information and output appropriate sound of the content audio for the listening environment.

The processor 13 may include a control program (or instructions) which makes it possible to control all the elements, a non-volatile memory in which the control program is installed, a volatile memory into which at least a part of the installed control program is loaded, and at least one processor or central processing unit (CPU) which executes the loaded control program. Such a control program may also be stored in an electronic apparatus other than the electronic apparatus 10.

The control program may include a program (or programs) implemented in at least one form of basic input/output system (BIOS), device driver, operating system, firmware, platform, and application program (or application). As an embodiment, the application program may be previously installed or stored in manufacturing the electronic apparatus 10, or when the electronic apparatus 10 is used, data of the application program may be received from the outside of the electronic apparatus 10, and the application program may be installed based on the received data. The data of the application program may be downloaded from a server, for example, an application market. Such a server is an example of a computer program product but is not limited thereto.

The electronic apparatus 10 is not limited to the configuration of FIG. 2 and may exclude some of the elements shown in FIG. 2 or include elements not shown in FIG. 2. For example, the electronic apparatus 10 may further include at least one of the display 14, a power supply, and a storage.

The display 14 may display an image based on a stored image signal or an image signal received from the outside of the electronic apparatus 10. When the display 14 receives an image from the outside and display the image, the electronic apparatus 10 may further include an image signal receiving unit including various image signal receiving circuitry for receiving an image signal and an image signal processing unit for performing various types of image processing so that the image signal can be displayed.

The display 14 is not limited to a specific implementation example and may be implemented, for example, and without limitation, as a liquid crystal display, a plasma display, a light-emitting diode display, an organic light-emitting diode display, a surface-conduction electron-emitter display, a carbon nanotubes display, a nanocrystal display, and the like. When user inputs are received through the display 14, the display 14 may be implemented as the touch panel 36.

The power supply may be supplied with power from the outside of the electronic apparatus 10 under the control of the processor 13 and may supply the power to the elements of the electronic apparatus 10 or store the power. The storage may store instructions, programs, and applications for controlling the electronic apparatus 10 or sound signals of various contents. For example, the storage unit may include, for example, and without limitation, at least one type of storage medium among a flash memory-type memory, a hard disk-type memory, a multimedia card micro-type memory, a card-type memory (e.g., a secure digital (SD) or extreme digital (XD) memory card), a random access memory (RAM), a read-only memory (ROM), or the like.

Figure 3:
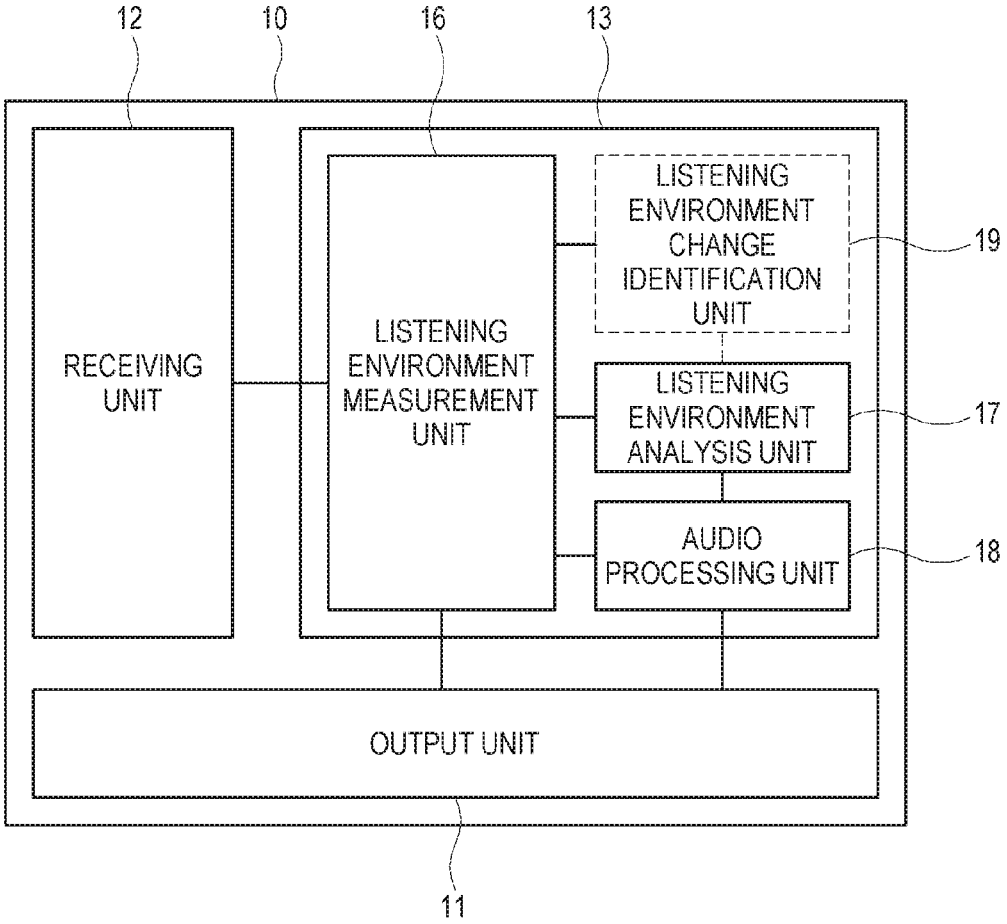
FIG. 3 is a block diagram illustrating another example configuration of the electronic apparatus of FIG. 1 according to an embodiment of the disclosure.

FIG. 3 is a block diagram illustrating another example configuration of the electronic apparatus 10 of FIG. 1 according to an embodiment of the disclosure. As shown in FIG. 3, the electronic apparatus 10 of FIG. 3 includes an output unit (e.g., including output circuitry) 11, a receiving unit (e.g., including receiving circuitry) 12, and a processor (e.g. including processing circuitry) 13. The processor 13 may include a listening environment measurement unit (e.g., including processing circuitry and/or executable program elements) 16, a listening environment analysis unit (e.g., including processing circuitry and/or executable program elements) 17, and an audio processing unit (e.g., including processing circuitry and/or executable program elements) 18. Description overlapping with that of FIG. 2 may not be repeated here, and the differences will be mainly described below.

The listening environment measurement unit 16 may include various processing circuitry and/or executable program elements and output the sound 21 to measure the listening environment of the space 1. The listening environment measurement unit 16 may measure the listening environment by outputting the sound 21 in an audible frequency band that the user 3 can hear. In other words, the listening environment measurement unit 16 may output the sound 21 in the audible frequency band through the output unit 11, receive the feedback sound 22 through the receiving unit 12 according to the sound 21, and measure the listening environment based on a characteristic difference between the sound 21 and the feedback sound 22.

The listening environment measurement unit 16 may measure the listening environment by outputting the sound 21 in an inaudible frequency band instead of the audible frequency band or the sound 21 in an audible frequency band and the inaudible frequency band. As an example, to remove aversion of the user 3 to the sound 21 in the audible frequency band, the listening environment measurement unit 16 may output the sound 21 in the inaudible frequency band instead of the audible frequency band and measure the listening environment based on the feedback sound 22 corresponding to the sound 21. As another example, when the sound 21 in the inaudible frequency band may improve reliability in measuring the listening environment compared with the sound 21 in the audible frequency band, the listening environment measurement unit 16 may output the sound 21 in the inaudible frequency band instead of the audible frequency band or output the sound 21 in the audible frequency band and the inaudible frequency band.

For example, the listening environment measurement unit 16 according to an example embodiment may output the sound 21 for measuring the listening environment according to a state of the user 3. For example, when there is a user input for performing a predetermined function, the listening environment measurement unit 16 may identify the state of the user 3 as the listening state and output the sound 21 in at least one of the audible frequency band and the inaudible frequency band according to the listening state.

The listening environment measurement unit 16 may acquire listening environment information based on the feedback sound 22 received through the receiving unit 11 according to the sound 21 for measuring the listening environment. The listening environment information may include listening environment information about a difference in volume, phase, etc. between the sound 21 and the feedback sound 22.

The listening environment analysis unit 17 may include various processing circuitry and/or executable program elements and analyze the listening environment of the space 1 based on the listening environment information acquired by the listening environment measurement unit 16. For example, the listening environment analysis unit 17 may identify whether there is resonance or reverberation in the space 1 based on the listening environment information.

The audio processing unit 18 may include various processing circuitry and/or executable program elements and correct content audio based on the listening environment identified by the listening environment analysis unit 17 and control the output unit 11 to output sound of the corrected content audio.

The content audio may be decomposed into primary components and ambient components according to the power of delivery, and the audio processing unit 18 may perform audio correction on the primary components and the ambient components based on the analyzed listening environment.

The primary components may, for example, include components which highly contribute to the power of delivery, such as dialogues, voices, etc. of the content audio, and the ambient components are components which barely contribute to the power of delivery, such as background sounds, sound effects, etc. of the content audio. For example, with regard to resonance in the space 1, the audio processing unit 18 may perform audio correction for increasing a gain of the primary components of the content audio, thereby improving the power of delivery of the content audio.

The audio processing unit 18 may correct the content audio according to frequency bands based on the listening environment. For example, with regard to reverberation in the space 1, the audio processing unit 18 may perform audio correction on a low frequency band of the content audio, thereby improving sound quality of the content audio.

Further, when audio correction causes a difference between input energy of the content audio and output energy of the content audio, the audio processing unit 18 may perform audio correction for removing or reducing the difference.

However, the electronic apparatus 10 is not limited to the configuration of FIG. 3, and accordingly, the processor may further include a listening environment change identification unit 19 including various processing circuitry and/or executable program elements. The listening environment change identification unit 19 may monitor whether the listening environment identified by the listening environment analysis unit 17 is changed. For example, the listening environment change identification unit 19 may generate a measurement value by quantifying the listening environment measured by the listening environment analysis unit 17 and identify whether the listening environment has been changed according to whether the measurement value of the listening environment has been changed.

Based on identifying that the listening environment has been changed, the listening environment change identification unit 19 may cause the listening environment measurement unit 16 to adjust the output frequency, the output level, etc. of the sound 21 for measuring the listening environment. This will be described in detail with reference to FIG. 10.

Based on identifying that the listening environment has been changed, the listening environment change identification unit 19 identifies an appropriate parameter to analyze the change in listening environment and causes the listening environment analysis unit 17 to analyze the listening environment based on the identified parameter. For example, when there is a change in listening environment, the listening environment change identification unit 19 may identify an appropriate frequency band to analyze the change in listening environment by checking a frequency variation of the feedback sound 22 and cause the listening environment analysis unit 17 to analyze the listening environment based on an identified frequency band.

The electronic apparatus 10 according to an example embodiment may measure a listening environment by outputting the sound 21 for measuring a listening environment according to a state of the user 3 and correct content audio according to the measured listening environment. According to the electronic apparatus 10 of an example embodiment, it is possible to improve reliability in measuring a listening environment by actively measuring a listening environment according to whether it is an appropriate situation to measure a listening environment and to output appropriate sound of content audio for the listening environment.

Figure 4:
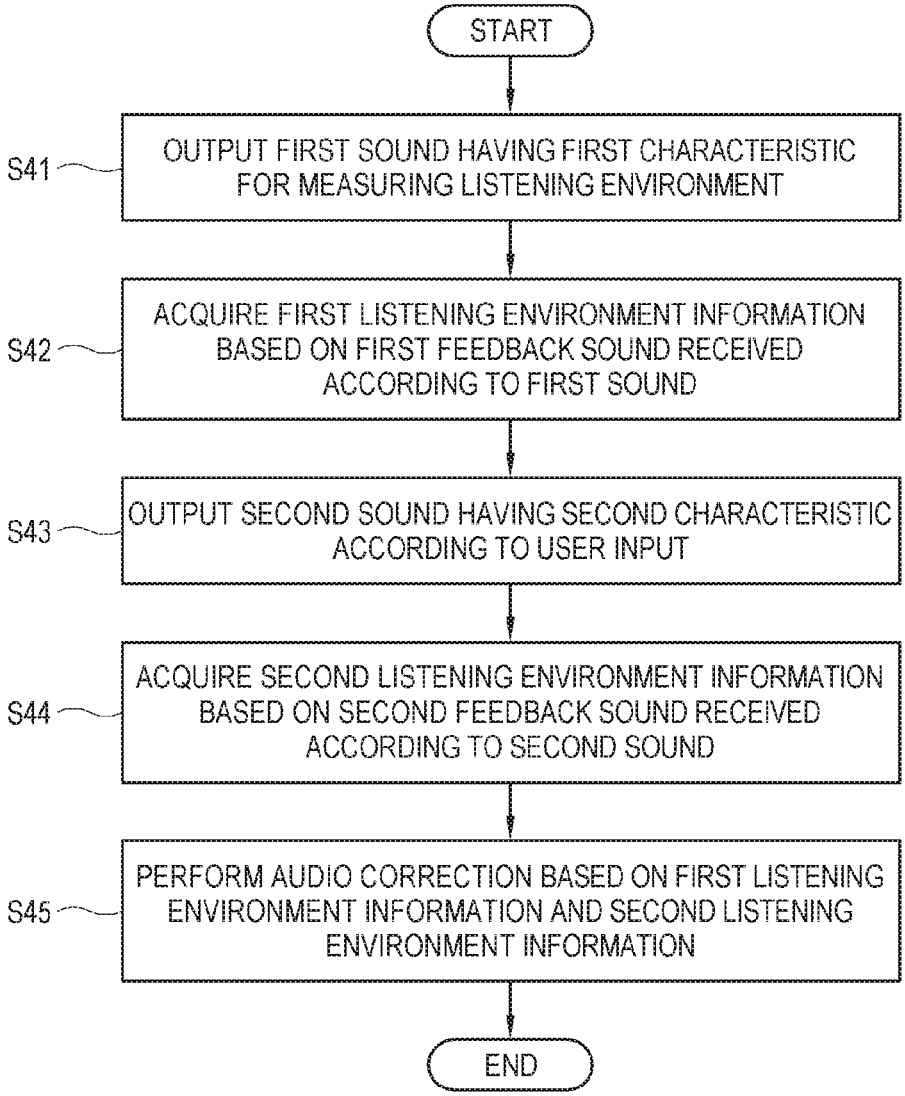
FIG. 4 is a flowchart illustrating an example method of controlling the electronic apparatus of FIG. 1 according to an embodiment of the disclosure.

FIG. 4 is a flowchart illustrating an example method of controlling the electronic apparatus 10 of FIG. 1. The control method of an example embodiment may be performed when the processor 13 of the electronic apparatus 10 executes the above-described control program. For convenience of description, operations performed by the processor 13 executing the control program will be simply described as operations of the processor 13 for ease and convenience of description, even though the operations may be performed by the electronic apparatus 10 under the control of the processor 13.

As shown in FIG. 4, the processor 13 of the electronic apparatus 10 according to an example embodiment may output a first sound having a first characteristic for measuring a listening environment (S41) and acquire first listening environment information based on a first feedback sound received according to the first sound (S42). For example, the first sound having the first characteristic may include, without limitation, sound in the inaudible frequency band, and the first listening environment information may include information about a characteristic difference between the first sound and the first feedback sound.

The processor 13 may output a second sound having a second characteristic according to an input, such as, for example, a user input (S43) and acquire second listening environment information based on a second feedback sound received according to the second sound (S44). For example, the user input may include a user input for performing a predetermined function of the electronic apparatus 10, and the processor 13 may identify a listening state of the user 3 based on a user input. In the listening state, the processor 13 may output the second sound in the audible frequency band and acquire second listening environment information about a characteristic difference between the second sound and the second feedback sound.

The processor 13 may perform audio correction based on the first listening environment information and the second listening environment information (S45). For example, the processor 13 may measure resonance or reverberation in the space 1 based on the first listening environment information and the second listening environment information and correct content audio to compensate for the measured resonance or reverberation.

The electronic apparatus 10 according to an example embodiment may measure a listening environment by outputting the sound 21 for measuring a listening environment according to a state of the user 3 and correct content audio according to the measured listening environment. According to the electronic apparatus 10 of an example embodiment, it is possible to improve reliability in measuring a listening environment by actively measuring a listening environment according to whether it is an appropriate situation to measure a listening environment and to output appropriate sound of content audio for the listening environment.

Figure 5:
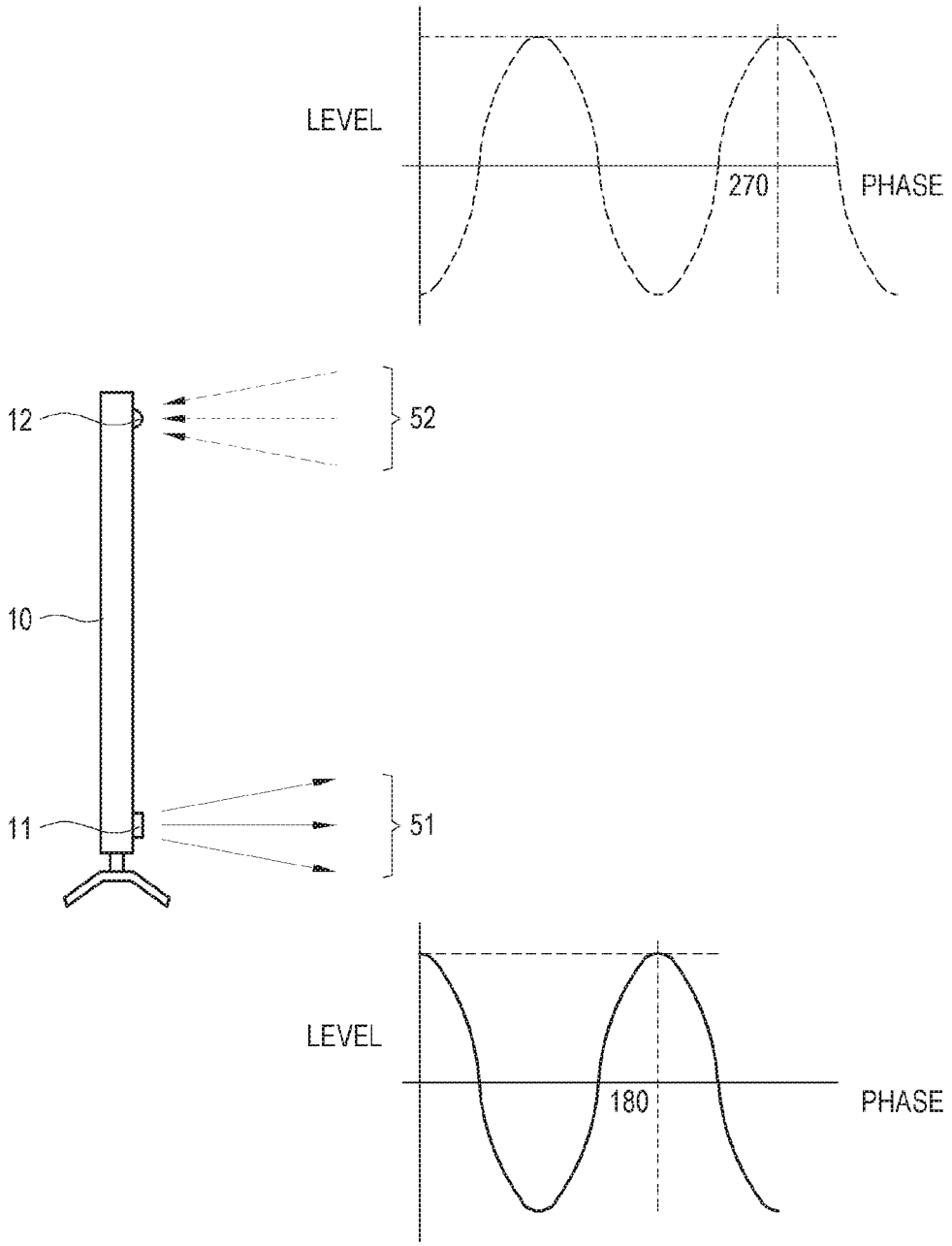
FIG. 5 is a diagram illustrating an example of measuring a listening environment and performing audio correction corresponding to the measured listening environment in relation to operations S41 to S45 of FIG. 4 according to an embodiment of the disclosure.
Figure 6:
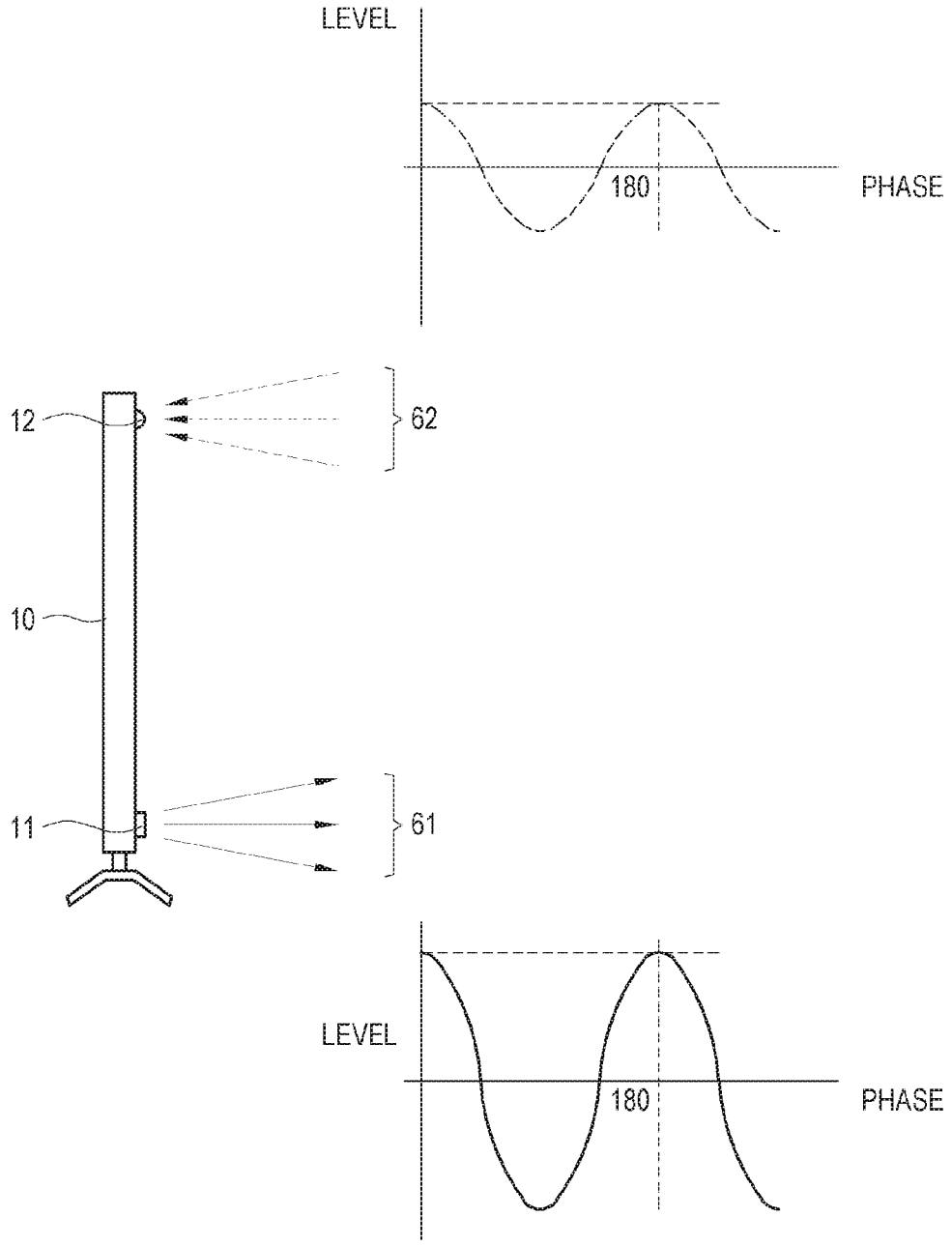
FIG. 6 is a diagram illustrating an example of measuring a listening environment and performing audio correction corresponding to the measured listening environment in relation to operations S41 to S45 of FIG. 4 according to an embodiment of the disclosure.

FIGS. 5 and 6 are diagrams illustrating examples of measuring a listening environment and performing audio correction corresponding to the measured listening environment in relation to operations S41 to S45 of FIG. 4 according to an embodiment of the disclosure. Referring to FIG. 5, the processor 13 of the electronic apparatus 10 according to an example embodiment may output a first sound 51 having an inaudible frequency band through the output unit 11 and receive a first feedback sound 52 corresponding to the first sound 51 through the receiving unit 12.

The processor 13 may measure a first listening environment based on the first sound 51 and the first feedback sound 52. For example, the processor 13 may measure resonance in the space 1 based on a phase difference between the first sound 51 and the first feedback sound 52. When the phase of the first feedback sound 52 is delayed by 90 degrees with respect to the phase of the first sound 51, the processor 13 may identify that there is resonance of 90 degrees in the space 1.

The processor 13 may correct content audio to compensate for the resonance. For example, to compensate for the resonance, the processor 13 may improve the power of delivery of the content audio through audio correction of increasing a gain of primary components of the content audio and decreasing a gain of ambient components.

Referring to FIG. 6, the processor 13 of the electronic apparatus 10 according to an example embodiment may output a second sound 61 having the audible frequency band through the output unit 11 and receive a second feedback sound 62 corresponding to the second sound 61 through the receiving unit 12.

The processor 13 may measure a second listening environment based on the second sound 61 and the second feedback sound 62. For example, the processor 13 may measure reverberation in the space 1 based on a volume difference between the second sound 61 and the second feedback sound 62. When a volume of the second feedback sound 62 is reduced by 1 compared with a volume of the second sound 61, the processor 13 may identify that there is reverberation in the space 1.

The processor 13 may correct content audio to compensate for the reverberation. For example, to compensate for the reverberation, the processor 13 may improve sound quality of the content audio by performing audio correction on a low frequency band of the content audio.

Figure 7:
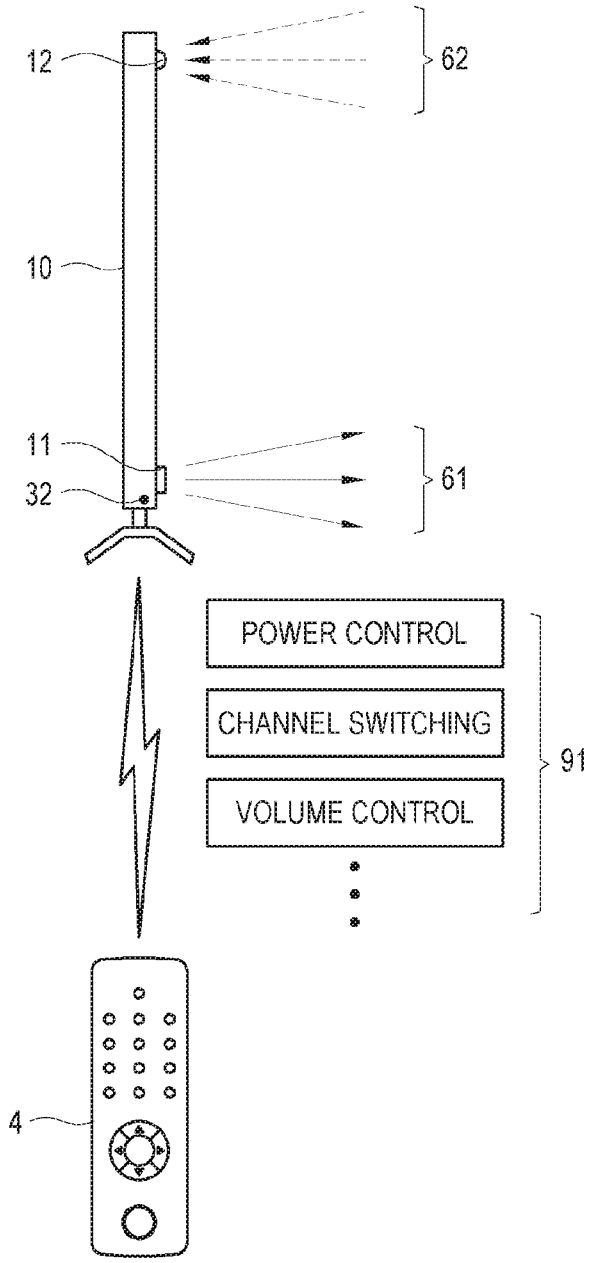
FIG. 7 is a diagram illustrating an example of outputting a second sound having a second characteristic according to a user input in relation to operation S43 of FIG. 4 according to an embodiment of the disclosure.
Figure 8:
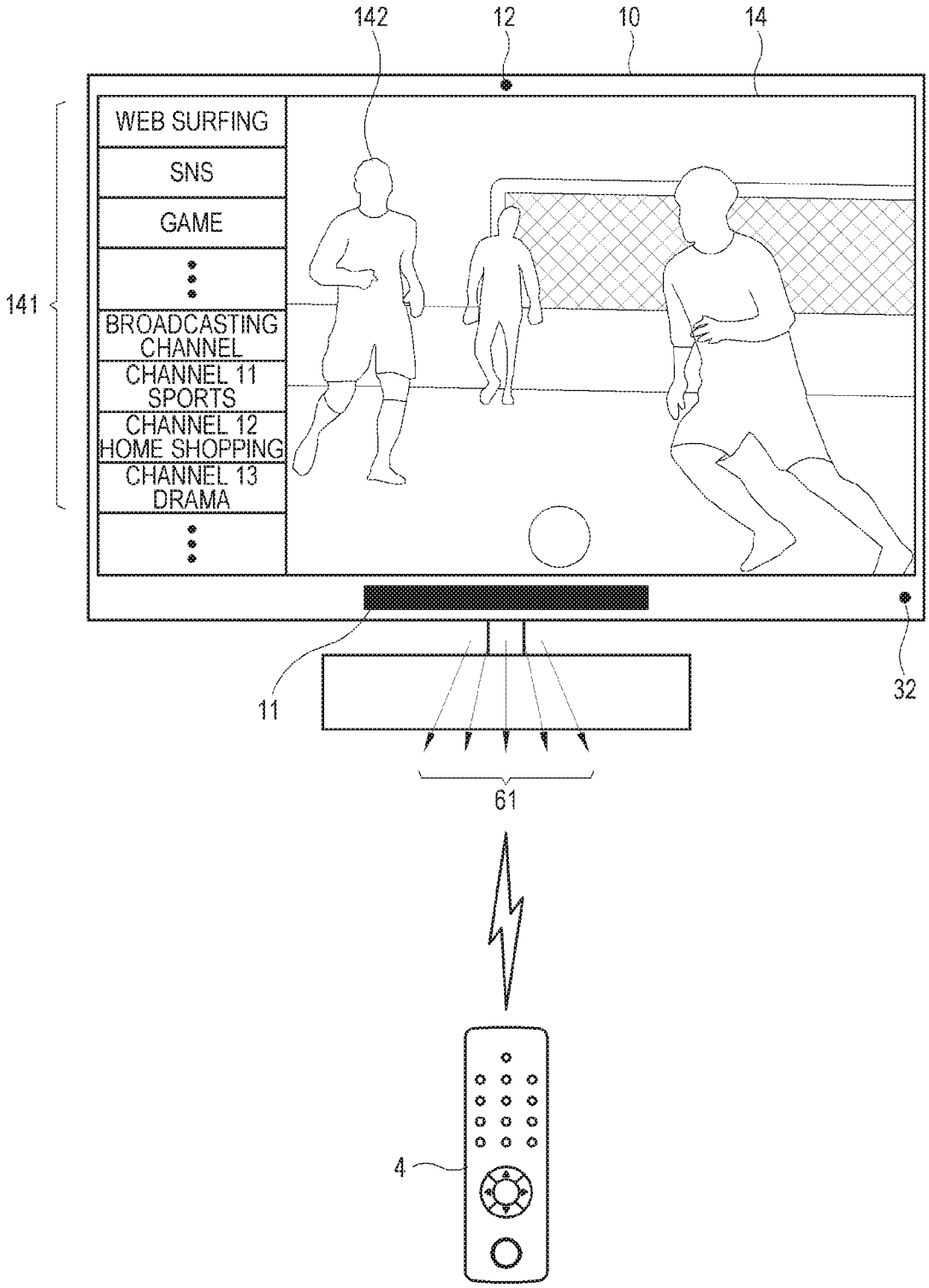
FIG. 8 is a diagram illustrating an example of outputting a second sound having a second characteristic according to a user input in relation to operation S43 of FIG. 4 according to an embodiment of the disclosure.

FIGS. 7 and 8 are diagrams illustrating example of outputting a second sound having a second characteristic according to a user input in relation to operation S43 of FIG. 4 according to an embodiment of the disclosure. Referring to FIG. 7, when there is a user input, the processor 13 of the electronic apparatus according to an example embodiment may output the second sound 61 having the audible frequency band. The user input may be input through the remote control 4 via, for example, the remote control signal module 32, but is not limited thereto.

The user input may be made for at least one of various functions 91 that can be performed or provided by the electronic apparatus 10. For example, the user input may include user inputs for performing functions which can be basically provided by a TV and the like, such as power control, channel switching, and volume control.

The second sound 61 is a sound output in response to the user input and may be a predetermined sound. For example, the predetermined sound may, for example, be the sound of a bell which gradually gets louder in response to a user input for turning on the power or may be the sound of a bell which gradually gets weaker in response to a user input for turning off the power. In other words, the predetermined sound may include a sound effect which is generally used when a predetermined function is performed in a TV or the like. However, the predetermined sound is not limited thereto and may be variously set according to designs.

When a listening environment is measured through the predetermined sound, such as a sound effect used in a TV or the like, in response to the user input, the user 3 may not recognize that the predetermined sound is a sound for measuring a listening environment or the listening environment is measured based on the predetermined sound while the listening environment is measured.

Therefore, the electronic apparatus 10 according to an example embodiment measures the listening environment while the user 3 does not recognize whether the listening environment is measured, thereby removing acoustic stress which may affect the user 3 to measure a listening environment.

Referring to FIG. 8, the processor 13 may display various content menus 141 on the display 14 and a content image 142 corresponding to a content menu 141 selected by a user input on the display 14. For example, a channel list may be displayed as the content menus 141, and when Channel 11 Sports is selected by a user input, the sports game image 142 may be displayed on the display 14.

The processor 13 may output the predetermined second sound 61 in response to display, movement, selection, or the like of the content menu 141 made by a user input. The second sound 61 may include a predetermined sound effect which is output in response to display, movement, selection, or the like of the content menu 141 made by a user input and may be variously set according to designs.

As in FIG. 7, when the listening environment is measured based on the predetermined sound effect according to display, movement, selection, or the like of the content menu 141 made by a user input, the user 3 may not recognize that the predetermined sound is a sound for measuring a listening environment or the listening environment is measured based on the predetermined sound while the listening environment is measured.

For example, when there is a user input for power control, channel switching, or volume control of FIG. 7 or a user input for display, movement, selection, or the like of a content menu 141 of FIG. 8, the processor 13 of the electronic apparatus 10 according to an example embodiment may measure the listening environment based on sound of the content image 142 displayed on the display 14. For example, when there is a user input for turning on the power of the electronic apparatus 10 or a user input for selecting Channel 11 Sports from among the content menus 141, a sports game image may be displayed on the display 14, and voice 61 of a sports commentator may be output. The processor 13 may measure the listening environment based on the voice 61 of the sports commentator which is output in response to the user input and a second feedback sound 62 received according to the voice 61. When the listening environment is measured based on the voice 61 of the sports commentator and the second feedback sound 62, the user 3 may not recognize whether the voice 61 of the sports commentator is a sound for measuring a listening environment or whether the listening environment is measured based on the voice 61 of the sports commentator.

The electronic apparatus 10 according to an example embodiment measures the listening environment while the user 3 does not recognize whether the listening environment is measured, thereby removing acoustic stress which may affect the user 3 to measure a listening environment.

Figure 9:
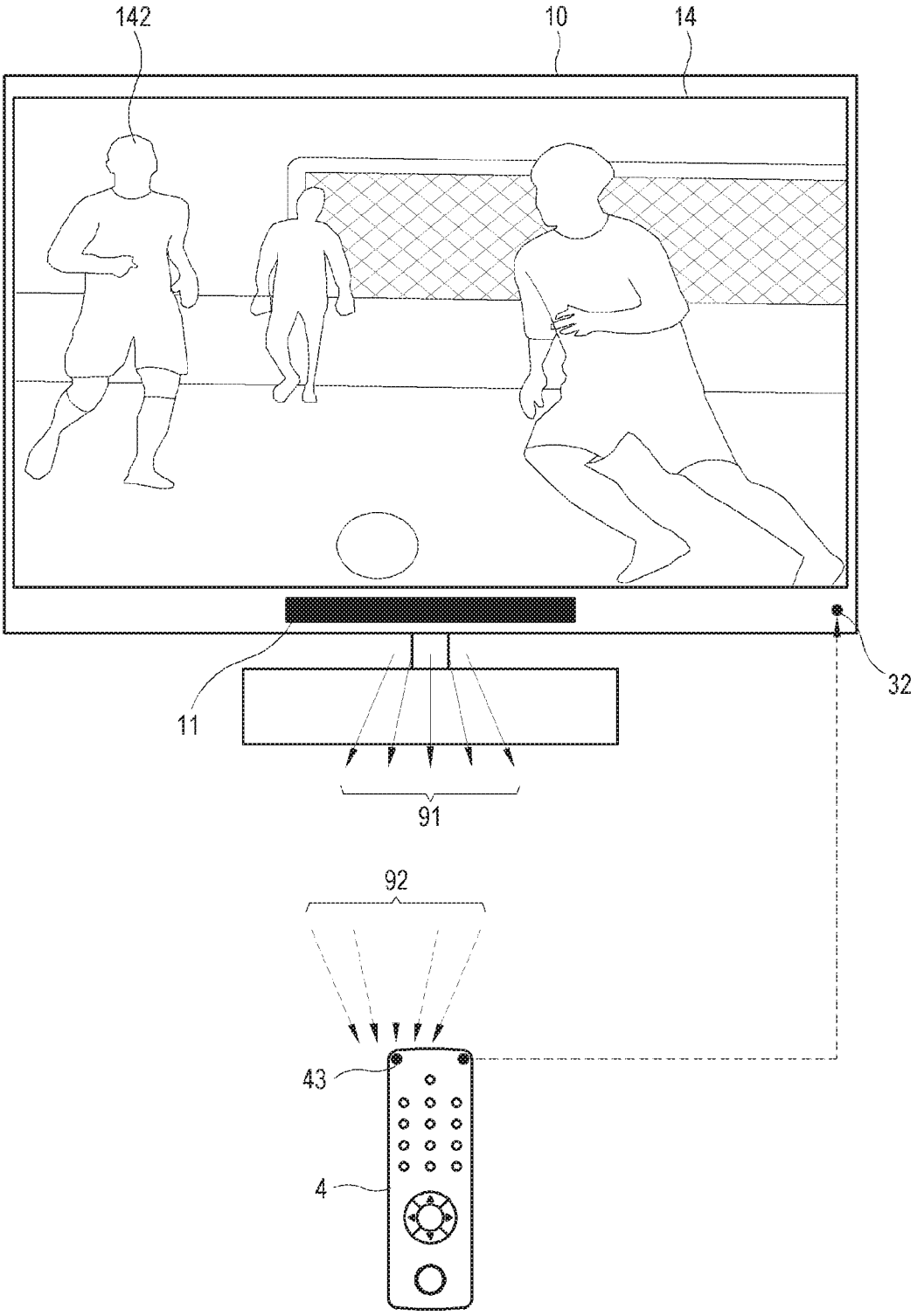
FIG. 9 is a diagram illustrating an example of receiving a feedback sound signal through a remote control in relation to operations S42 and S44 of FIG. 4 according to an embodiment of the disclosure.

FIG. 9 is a diagram illustrating an example of receiving a feedback sound signal through the remote control 4 in relation to operations S42 and S44 of FIG. 4 according to an embodiment of the disclosure. Referring to FIG. 9, the electronic apparatus 10 according to an example embodiment may output a sound 91 to measure a listening environment. The sound 91 may include a first sound having a first characteristic and a second sound having a second characteristic.

The remote control 4 may receive a feedback sound 92, which corresponds to the sound 91 output from the electronic apparatus 10, through a receiving unit 43. The receiving unit 43 of the remote control 4 may be implemented as a microphone. The remote control 4 may transmit a signal of the feedback sound 92 received through the receiving unit 43 to the electronic apparatus 10.

The electronic apparatus 10 may receive the signal of the feedback sound 92 from the remote control 4 through wireless communication with the remote control 4. For example, the electronic apparatus 10 may receive the signal of the feedback sound 92 from the remote control 4 through BT communication or BLE communication. In this case, the electronic apparatus 10 may receive the signal of the feedback sound 92 in consideration of limits of the frequency band of BT communication or BLE communication.

When it is difficult to simultaneously transmit a signal of a first feedback sound and a signal of a second feedback sound in the audible frequency band through the frequency band of BT communication or BLE communication, the electronic apparatus 10 may sequentially receive the signal of the first feedback sound in the inaudible frequency band and the signal of the second feedback sound in the audible frequency band.

The electronic apparatus 10 according to an example embodiment may receive the signal of the feedback sound 92 without distortion or loss caused by the limitations of a frequency band by sequentially receiving the signal of the feedback sound 92 in consideration of the frequency band for wireless communication with the remote control 4.

Figure 10:
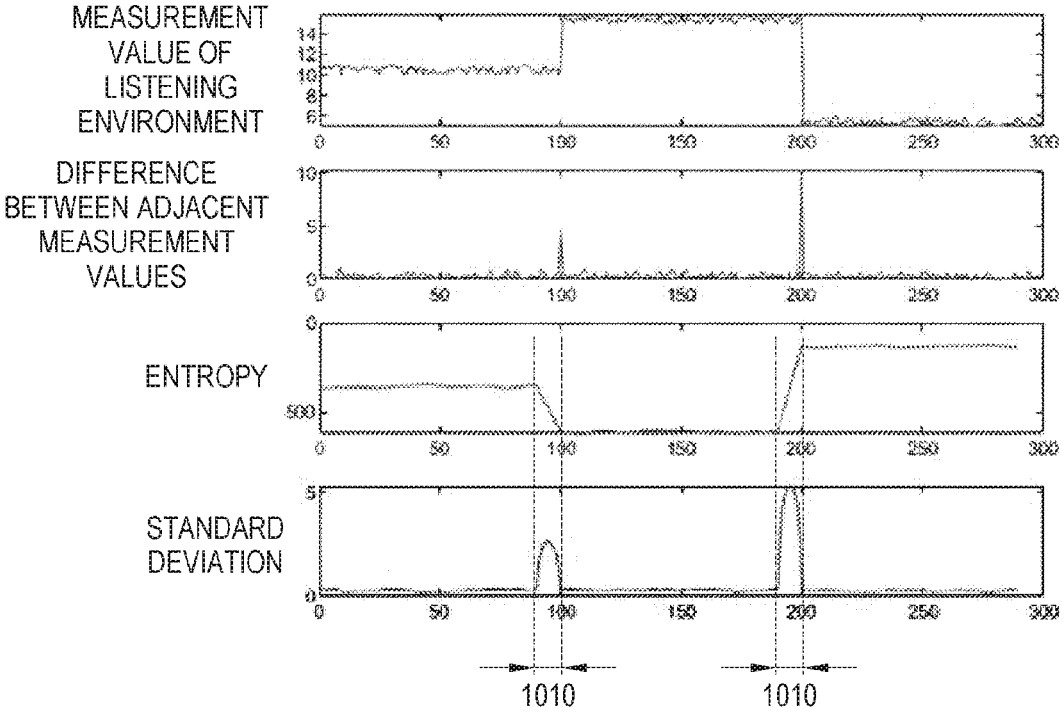
FIG. 10 is a diagram illustrating an example of adjusting the frequency of measuring a listening environment in relation to operations S41 to S44 of FIG. 4 according to an embodiment of the disclosure.

FIG. 10 is a diagram illustrating an example of adjusting the frequency of measuring a listening environment in relation to operations S41 to S44 of FIG. 4 according to an embodiment of the disclosure. Referring to FIG. 10, the processor 13 of the electronic apparatus 10 according to an example embodiment may measure the listening environment based on the first listening environment information and the second listening environment information acquired in operations S41 to S45 of FIG. 4. The processor 13 may generate a measurement value of the listening environment by quantifying the measured listening environment.

The processor 13 may monitor the measurement value of the listening environment and identify whether the listening environment has been changed based on a change in the measurement value of the listening environment. As an example, as shown in FIG. 10, the processor 13 may identify that the listening environment has been changed when a difference between measurement values of the listening environment which are temporally adjacent to each other is a predetermined upper limit value or more, and may identify that the listening environment has not been changed when the difference between measurement values of the listening environment which are temporally adjacent to each other is less than the predetermined upper limit value.

As another example, the processor 13 may identify that the listening environment has been changed based on the entropy of a difference between measurement values of the listening environment which are temporally adjacent to each other. The processor 13 may identify that the listening environment has been changed when the entropy decreases or increases for a predetermined time period, and may identify that the listening environment has not been changed when the entropy is stabilized.

As another example, the processor 13 may identify that the listening environment has been changed based on the standard deviation of a difference between measurement values of the listening environment which are temporally adjacent to each other. The processor 13 may identify that the listening environment has been changed when the standard deviation decreases or increases for a predetermined time period, and may identify that the listening environment has not been changed when the entropy is stabilized. However, the disclosure is not limited to these examples, and the processor 13 may identify whether the listening environment has been changed according to various algorithms or methods.

Based on identifying that the listening environment has been changed, the processor 13 may adjust the frequency of measuring the listening environment. As an example, when a difference between measurement values of the listening environment which are temporally adjacent to each other is the predetermined upper limit value or more as shown in FIG. 10, the frequency of measuring the listening environment may be increased until the difference between measurement values of the listening environment which are temporally adjacent to each other becomes the predetermined upper limit value or less and stabilized.

As another example, the processor 13 may increase the frequency of measuring the listening environment for a time period 1010 in which the entropy of a difference between measurement values of the listening environment temporally adjacent to each other is changed, and may increase the frequency of measuring the listening environment for the time period 1010 in which the standard deviation of a difference between measurement values of the listening environment temporally adjacent to each other is changed. There can be one or more time periods 1010 in which the entropy or standard deviation is changed.

Based on there being a change in a listening environment, the electronic apparatus 10 according to the embodiment can improve reliability in measuring the listening environment by increasing the frequency of measuring the listening environment.

According to the disclosure, it is possible to provide an electronic apparatus, which can improve reliability in measuring a listening environment by actively measuring a listening environment according to whether it is an appropriate situation to measure a listening environment and can lessen acoustic stress of a user by unconsciously measuring the listening environment, and a method of controlling the electronic apparatus.

While various example embodiments have been illustrated and described, it will be understood by those skilled in the art that various changes in form and detail may be made without departing from the principles and spirit of the disclosure, which includes the appended claims and their equivalents.

What is claimed is:

1. An electronic apparatus comprising:

an output unit comprising output circuitry;

a receiving unit comprising receiving circuitry; and a processor configured to control the electronic apparatus to:

based on a user input for performing a function available for the electronic apparatus not being received, output a first sound having an inaudible frequency band for obtaining information corresponding to a listening environment of a room through the output unit, obtain first information corresponding to the listening environment based on a first feedback sound received through the receiving unit based on the output first sound, based on the user input for performing the function available for the electronic apparatus being received, output a second sound having an audible frequency band through the output unit, obtain second information corresponding to the listening environment based on a second feedback sound received through the receiving unit based on the output second sound, and perform a function corresponding to audio correction based on the obtained first information and second information.

2. The electronic apparatus of claim 1, wherein the first information comprises information about resonance of the first sound caused by an ambient space of the electronic apparatus.

3. The electronic apparatus of claim 2, wherein the inaudible frequency band is for measuring resonance of the output first sound.

4. The electronic apparatus of claim 1, wherein the second information comprises information about reverberation of the second sound caused by an ambient space.

5. The electronic apparatus of claim 4, wherein the audible frequency band is for measuring reverberation of the output second sound.

6. The electronic apparatus of claim 1, wherein the input comprises an input causing the electronic apparatus to perform a predetermined function.

7. The electronic apparatus of claim 6, wherein the predetermined function comprises at least one of power control, channel switching, or volume control of the electronic apparatus.

8. The electronic apparatus of claim 1, wherein the processor is configured to control the electronic apparatus to: decompose content audio into primary components and ambient components, and perform audio correction of the primary components and the ambient components based on the acquired first listening environment information and second listening environment information.

9. The electronic apparatus of claim 1, wherein the processor is configured to control the electronic apparatus to: divide a frequency band of content audio, and perform audio correction on the divided frequency bands of the content audio based on the acquired first listening environment information and second listening environment information, wherein a different correction is applied to the divided frequency bands.

10. The electronic apparatus of claim 1, further comprising:

a communication unit comprising communication circuitry configured to wirelessly communicate with a remote control, wherein the processor is configured to control the electronic apparatus to: sequentially receive a signal of the first feedback sound and a signal of the second feedback sound from the remote control through the communication unit.

11. The electronic apparatus of claim 1, wherein the processor is configured to control the electronic apparatus to: change at least one of the first characteristic or the second characteristic based on a change in listening environment detected based on the acquired first listening environment information and second listening environment information.

12. The electronic apparatus of claim 1, wherein the processor is configured to control the electronic apparatus to: increase output frequencies of the first sound and the second sound based on a change in listening environment detected based on the acquired first listening environment information and second listening environment information.

13. A method of controlling an electronic apparatus, the method comprising:

outputting, using a speaker of the electronic apparatus, a first sound having an inaudible frequency band for obtaining information corresponding to a listening environment of a room;

obtaining first information corresponding to the listening environment based on a first feedback sound received based on the output first sound;

based on user input for performing a function available for the electronic apparatus being received, outputting a second sound having an audible frequency band;

obtaining second information corresponding to the listening environment based on a second feedback sound received based on the output second sound; and performing a function corresponding to audio correction based on the obtained first information and second information.

14. The method of claim 13, wherein the first listening environment information comprises information about resonance of the first sound caused by an ambient space of the electronic apparatus.

15. The method of claim 14, wherein the inaudible frequency band includes an inaudible frequency band for measuring resonance of the output first sound.

16. The method of claim 13, wherein the second information comprises information about reverberation of the second sound caused by an ambient space.

17. The method of claim 16, wherein the audible frequency band includes an audible frequency band for measuring reverberation of the output second sound.

18. The method of claim 13, wherein the input comprises an input causing the electronic apparatus to perform a predetermined function.

19. A non-transitory computer-readable recording medium having stored thereon a computer program comprising a computer-readable code that when executed causes an electronic apparatus to perform a method of controlling an electronic apparatus, the method of controlling the electronic apparatus comprising:

outputting, using a speaker of the electronic apparatus, a first sound having an inaudible frequency band for obtaining information corresponding to a listening environment of a room;

obtaining first information corresponding to the listening environment based on a first feedback sound received based on the output first sound;

based on user input for performing a function available for the electronic apparatus being received, outputting a second sound having an audible frequency band;

obtaining second information corresponding to the listening environment based on a second feedback sound received based on the output second sound; and performing a function corresponding to audio correction based on the obtained first information and second information.

* * * * *